US005380408A

United States Patent [19]

Svensson

[11] Patent Number: 5,380,408

[45] Date of Patent: Jan. 10, 1995

[54] ETCHING PROCESS

[75] Inventor: Rolf Svensson, Hagersten, Sweden

[73] Assignee: Sandvik AB, Sandviken, Sweden

[21] Appl. No.: 995,914

[22] Filed: Dec. 22, 1992

Related U.S. Application Data

[63] Continuation of Ser. No. 882,114, May 13, 1992, abandoned.

[30] Foreign Application Priority Data

May 15, 1991 [SE] Sweden ..... 9101469

[51] Int. Cl.[6] ..... C25F 3/08; C23F 1/00

[52] U.S. Cl. ..... 204/129.1; 204/129.8; 204/129.95; 204/129.35; 204/129.46; 156/656

[58] Field of Search ..... 204/129.8, 129.95, 129.35, 204/141.5; 156/656

[56] References Cited

U.S. PATENT DOCUMENTS

| | | | |
|---|---|---|---|
| 2,334,698 | 11/1943 | Faust | 204/140 |
| 2,334,699 | 11/1943 | Faust | 204/140 |
| 2,338,321 | 1/1944 | Faust | 204/145 |
| 2,429,676 | 10/1947 | Faust | 204/140 |
| 2,440,715 | 5/1948 | Faust | 204/140 |
| 2,493,579 | 1/1950 | Hammond et al. | 204/140.5 |
| 2,550,544 | 4/1951 | Faust | 204/140.5 |
| 2,594,124 | 4/1952 | Charlesworth | 204/140.5 |
| 2,820,750 | 1/1958 | Charlesworth | 204/140.5 |
| 4,140,597 | 2/1979 | Kobayakawa | 204/141.5 X |
| 4,169,026 | 9/1979 | Kikuchi et al. | 204/129.65 |
| 4,282,289 | 8/1981 | Kullander et al. | 428/457 |
| 4,610,931 | 9/1986 | Nemeth et al. | 428/547 |
| 4,710,279 | 12/1987 | Hozer | 204/129.55 |
| 4,740,280 | 4/1988 | Ruhstorfer | 204/129.95 |
| 4,911,989 | 3/1990 | Minoru et al. | 428/547 |
| 5,135,801 | 8/1992 | Nyström et al. | 428/216 |

FOREIGN PATENT DOCUMENTS

| | | |
|---|---|---|
| 63-050279 | 3/1988 | Japan . |
| 63-053269 | 3/1988 | Japan . |
| 63-060280 | 3/1988 | Japan . |

OTHER PUBLICATIONS

Electropolishing, G. R. Schaer, Columbus, Ohio.
Electroplating Engineering Handbook, Graham, 1962.
Metal Finishing, Electropolishing, The Practical Side–II, Charles L. Faust, Columbus, Ohio, Aug. 1982.
Metal Finishing, Electropolishing, Stainless Steel, Charles L. Faust, Columbus, Ohio, Sep. 1982.
Metal Finishing, Columbus, Ohio, Nov. 1982, p. 67.
Metal Finishing, Electropolishing, Stainless Steel–Electropolishing Large Vessels and Tubes–Part I, Charles L. Faust, Columbus, Ohio, Feb. 1983.
The Monthly Review, Electrolytic Polishing, Joseph Mazia, Aug. 1947, p. 942.

*Primary Examiner*—Donald R. Valentine
*Attorney, Agent, or Firm*—Burns, Doane, Swecker & Mathis

[57] ABSTRACT

The present invention relates to an etching process for the purpose of removing binder phase from the surface of a hard metal consisting of hard material in a binder phase based on cobalt and/or nickel. By carrying out the etching process electrolytically in a mixture containing concentrated sulfuric acid and concentrated phosphoric acid at a volume ratio of 0.5–2 with a water content of <50% at a temperature of 25°–60° C. an even binder phase removal without deep penetration is achieved.

10 Claims, 1 Drawing Sheet

ETCHING PROCESS

This application is a continuation of application Ser. No. 07/882,114, filed May 13, 1992, now abandoned.

BACKGROUND OF THE INVENTION

The present invention relates to an etching process for the purpose of removing the binder phase from the surface of hard material inserts before applying coatings on said surface.

Coated cemented carbide inserts have for many years been commercially available for the chip cutting machining of metals in the metal cutting industry. Such inserts are commonly made of a metal carbide, normally WC, generally with the addition of carbides of other metals such as Nb, Ti, Ta, etc., and a metallic binder phase, generally of Co. By depositing a thin layer of a wear resistant material such as TiC, TiN, $Al_2O_3$, etc., separately or in combination onto said cemented carbide inserts it has been possible to increase the wear resistance without adversely affecting the toughness. A still further improvement in properties has been achievable by subjecting the inserts to a binder phase enrichment in the surface below the coating, a so-called cobalt gradient. Binder phase enrichment can be accomplished, for instance, by sintering in vacuum while adding nitride as is disclosed in U.S. Pat. No. 4,610,931 or by controlled cooling as discussed in U.S. Pat. No. 4,911,989. Such inserts, however, often also appear with a thin layer of binder phase on their surface and sometimes they even appear with a layer of graphite thereon. The latter two types of layers have a negative effect on the process when carrying out CVD- or PVD-deposition which results in layers with inferior properties and insufficient adherence. These layers must therefore be removed before carrying out the deposition process.

It is possible to remove such cobalt and possible graphite-layers mechanically by blasting. The blasting method is, however, difficult to control. The difficulty resides in the inability to consistently control the blasting depth with necessary accuracy which leads to an increased scatter in the properties in the final product—the coated insert.

Chemical or electrolytic methods could be used as alternatives for mechanical methods. U.S. Pat. No. 4,282,289 discloses a method of etching in a gaseous phase by using HCl in an initial phase of the coating process. In U.S. Pat. No. 4,911,989 there is disclosed a wet chemical method of etching in nitric acid, hydrochloric acid, hydrofluoric acid, sulfuric acid or similar or electro-chemical methods. From JP 88-060279 it is previously known to use an alkaline solution, e.g., NaOH, and from JP 88-060280 to use an acid solution. JP 88-053269 discloses etching in nitric acid before diamond deposition. There is one drawback with these methods, namely, that they are incapable of only removing the cobalt layer. They also result in deep penetration particularly in areas close to the edge. The etching medium not only removes cobalt from the surface but also penetrates areas between the hard material grains, the result of which is an undesired porosity between the layer and the substrate at the same time as the cobalt layer may partially remain in other areas of the insert.

OBJECTS AND SUMMARY OF THE INVENTION

It is an object of this invention to avoid or alleviate the problems of the prior art.

It is also an object of the present invention to provide an etching method that is not associated with a deep penetration effect.

It is further an object of this invention to provide an improved process removing graphite and/or binder phase layers which form during sintering from the surface of hard material cutting inserts.

In respect to the invention, there is provided a method to remove binder phase from the surface of hard material inserts containing hard constituents in a binder phase based on cobalt and/or nickel, comprising etching said inserts electrolytically in a mixture of concentrated sulfuric acid and concentrated phosphoric acid in a volume ratio of 0.5–2 with a water content of $<50\%$ at a temperature of 25°–60° C. and the resulting product (uncoated or coated with a thin, wear-resistant layer of a metal carbide, oxide, nitride or mixtures thereof or diamond deposited on the etched surface).

DETAILED DESCRIPTION OF THE PREFERRED EMBODIMENTS OF THE INVENTION

Figure 1:
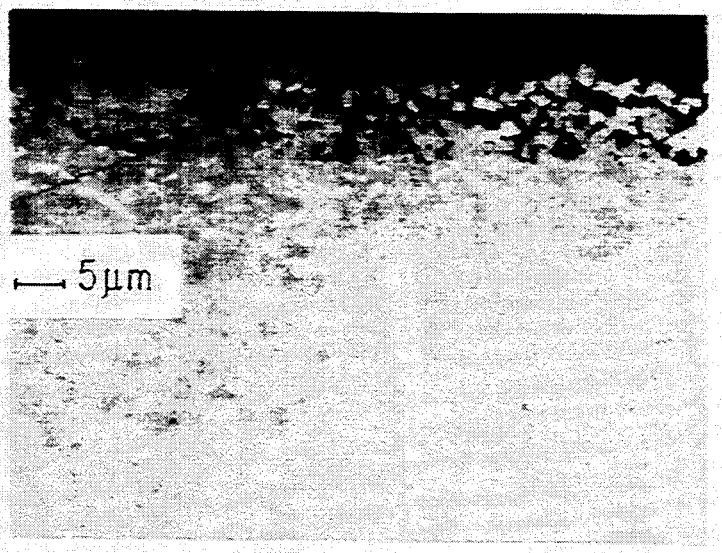
FIG. 1 PRIOR ART
FIG. 1 is a 1200X magnification of a cross-section of the surface zone of a cemented carbide insert after being subjected to electrolytic etching according to prior art.

It has now surprisingly been found that use of a mixture containing concentrated sulfuric acid $H_2SO_4$, and concentrated phosphoric acid, $H_3PO_4$, gives the desired effect of cleanly and uniformly removing the surface layer of binder metal and any graphite. By using such a mixture of acids, the cobalt layer on the surface will be effectively removed whereas the cobalt in the channels between the hard material grains will not be etched away. The binder phase layers between the carbide grains, which are necessary for the strength of the cemented carbide are not affected. This method turns out to be self-regulating. When the cobalt layer has disappeared the process stops which means that the length of the process time is not critical.

The reason why the electrolytic solution of the present invention gives rise to such positive results is not completely known. There is probably a combined correlation between the viscosity and the solubility of the salts obtained. Usage of diluted sulfuric acid, for instance, gives rise to deep penetration.

The electrolytic etching process is carried out in a manner known per se. The selection of voltage, current density, time, etc., depends on the thickness of cobalt and possible graphite layer, amount of inserts and construction of equipment and, to obtain the best result, has to be determined by experiments within the skill of the artisan. The electrolytic solution is a mixture of commercially available concentrated sulfuric and phosphoric acids in volume ratio 0.5–2, preferably 0.75–1.25, mostly 0.95–1.05. The amount of water in this solution is $<50\%$, preferably $<25\%$, mostly $<15\%$. The etching is suitably carried out at a combination of time, current and exposed surface that amounts to 150 $As/cm^2$. However, in production scale, operating at constant voltage is generally more convenient. The temperature of the electrolytic solution shall be 25°–60° C. Precautions must be adhered to when carrying out the etching since explosive or health damaging gases and vapors might develop.

After finalizing the etching process, the inserts may be neutralized and cleaned, for instance by rinsing in alkaline baths followed by rinsing in water. Cleaning is suitably carried out by ultra-sonic means followed by drying.

Still further improved results can be obtained in those cases where a graphite layer appears on top of the cobalt layer. By carrying out a light wet blasting or mechanical working before the etching process, essentially only the graphite will be removed. This avoids those problems that might occur when insufficient electrical contact is obtained between inserts and current supply which leads to insufficient etching effect. Further, difficulties with removal of graphite flakes during the etching process are avoided.

Removing the binder phase by the etching process of this invention results in a substrate with a well-defined hard surface which is very suitable for the deposition of a thin, wear-resistant layer of a metal carbide, oxide, nitride or mixtures thereof. e.g., TiC, TiN, $Al_2O_3$, or diamond etc., by using CVD- and PVD-methods. A further advantage of using the etching method of the invention is the reduced risk for decarburization of the substrate surface and eta phase formation associated therewith when carrying out deposition with CVD-methods. The decarburization zone can in certain areas of prior inserts, result in negative effects on the cutting properties of the final product.

The invention has been described above with reference to binder phase enriched cemented carbide. The method can also be applied to coated or uncoated conventional cemented carbide, i.e., hard material based on carbides of W, Ti, Ta and/or Nb in a binder phase of cobalt as well as to other types of hard materials containing hard constituents (carbides, nitrides, carbonitrides, etc.) in a binder phase based on cobalt and/or nickel, such as titanium-based carbonitride alloys usually called cermets.

The invention is additionally illustrated in connection with the following Examples which are to be considered as illustrative of the present invention. It should be understood, however, that the invention is not limited to the specific details of the Examples.

EXAMPLE 1 (prior art)

Cemented carbide inserts type CNMG120408-QM with a composition of WC, 8.5% (TiC+TaC+NbC) and 5.5% Co made by sintering so that they had a binder phase enriched surface zone, a cobalt layer of about 2 μm thickness and a graphite layer of about 2 μm thereon were subjected to electrolytic etching in diluted 10% sulfuric acid. By applying 1–2 V voltage and 30–70 As/cm$^2$ weight losses of 55–130 mg/insert were obtained which resulted in etching away cobalt in certain areas up to 30 μm, in depth, see FIG. 1.

EXAMPLE 2

Figure 2:
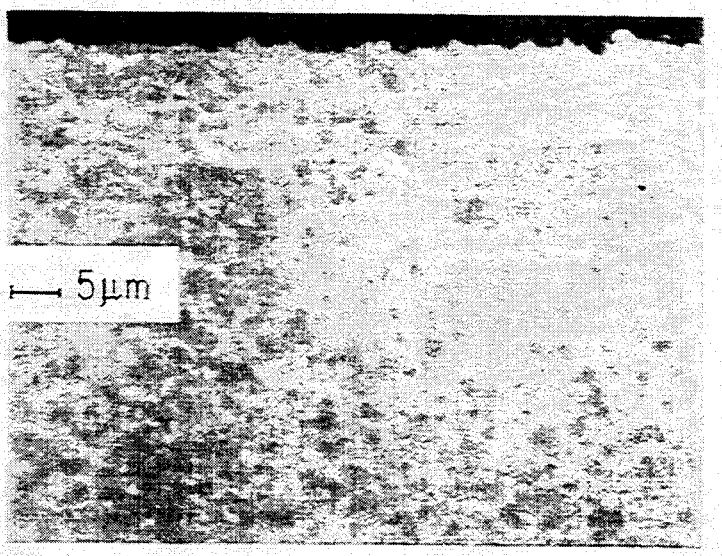
FIG. 2 shows in 1200X a cross section of the surface after electrolytic etching according to the invention.

Cemented carbide inserts made in accordance with Example 1 were subjected to etching in a mixture of concentrated sulfuric acid and concentrated phosphoric acid in a volume ratio of 1:1 at a temperature of about 50° C. In this case a weight loss in an amount of 10–14 mg/insert was obtained at the applied voltage 4.5–5 V and 50–140 As/cm$^2$ after same time as in Example 1. The cobalt layer was removed without any deep penetration as appears from FIG. 2.

EXAMPLE 3

Example 2 was reproduced with the exception that the inserts were initially subjected to a light wet blasting with 150 mesh $Al_2O_3$ at 1.2 bar pressure during 2 minutes in order to remove the graphite layer. At 35–40 As/cm$^2$ and a voltage of 6 V a weight loss of about 5–8 mg/insert was obtained without any deep penetration.

EXAMPLE 4

Example 2 was repeated with the difference that the etching was performed with an applied constant voltage of 15 V and 50–100 As/cm$^2$. The weight loss was in this case 10–12 mg/insert without any deep etching.

EXAMPLE 5

Inserts type TNMG 160408-QF of a titanium based carbonitride alloy and a binder phase of about 10% cobalt and 5% nickel were provided. After the sintering step these inserts had a binder phase layer of about 2 μm thickness on the surface. These inserts were subjected to etching in accordance with Example 2, however, at 50–90 As/cm$^2$ and a voltage of 6 V. The measured weight loss was 6–9 mg/insert. No deep penetration was observed.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method for removing a layer of binder phase formed on the surface of a hard material insert containing hard constituents in a binder phase based on cobalt and/or nickel, comprising removing said layer of binder phase formed on the surface of said insert by etching said insert electrolytically in a mixture of concentrated sulfuric acid and concentrated phosphoric acid in a volume ratio of 0.5–2 with a water content of <50% at a temperature of 25°–60° C.

2. The method of claim 1 wherein the surface of the hard material inserts is initially subjected to a mechanical treatment before the electrolytic etching step.

3. The method of claim 1 wherein said hard constituents comprise WC.

4. The method of claim 3 wherein said binder phase is cobalt.

5. The method of claim 1 wherein said mixture of concentrated sulfuric acid and concentrated phosphoric acid is in a volume ratio 0.75 to 1.25 with a water content of <25%.

6. The method of claim 5 wherein said mixture of concentrated sulfuric acid and concentrated phosphoric acid is in a volume ratio 0.95 to 1.05 with a water content of <15%.

7. The method of claim 1 wherein said surface further contains a graphite layer overlying said binder phase layer, said graphite layer being essentially removed prior to said electrolytic etching step.

8. The method of claim 1 wherein after said etching, a thin, wear-resistant layer of a metal carbide, oxide, nitride or mixtures thereof or diamond is deposited on said etched surface.

9. A method for removing a layer of binder phase formed on the surface of a hard material insert, comprising removing a binder enriched layer formed on the surface of a hard material insert containing hard constituents in a binder phase based on cobalt and/or nickel, without removal of binder phase in channels between the hard material grains in said insert, by etching said inserts electrolytically in a mixture of concentrated sulfuric acid and concentrated phosphoric acid in a volume ratio of 0.5–2 with a water content of <50% at a temperature of 25°–60° C.

10. A method of treating a hard material insert having a surface layer containing cobalt and/or nickel and a base layer containing hard constituents in a binder phase based on cobalt and/or nickel, comprising removing said surface layer of cobalt and/or nickel from said base layer without formation of pores by removal of binder phase between said hard constituents in said base layer by etching said insert in a mixture of concentrated sulfuric acid and concentrated phosphoric acid in a volume ratio of 0.5–2 with a water content of <50% at a temperature of 25°–60° C.

* * * * *